US005466150A

United States Patent [19]

Albersdörfer et al.

[11] Patent Number: 5,466,150

[45] Date of Patent: Nov. 14, 1995

[54] SAGGER WALL FOR A RING PIT FURNACE

[75] Inventors: Gernot Albersdörfer, Lauf; Reiner Swoboda, Eckental, both of Germany

[73] Assignee: Riedhammer GmbH und Co. KG, Nuremberg, Germany

[21] Appl. No.: 157,187

[22] PCT Filed: Apr. 12, 1992

[86] PCT No.: PCT/DE92/00298

§ 371 Date: Dec. 8, 1993

§ 102(e) Date: Dec. 8, 1993

[87] PCT Pub. No.: WO92/22780

PCT Pub. Date: Dec. 23, 1992

[30] Foreign Application Priority Data

Jun. 12, 1991 [DE] Germany ..... 41 19 320.2

[51] Int. Cl.[6] ..... F27B 7/00

[52] U.S. Cl. ..... 432/192; 432/252; 110/173 A

[58] Field of Search ..... 432/192, 252, 432/193, 164; 110/173 A

[56] References Cited

U.S. PATENT DOCUMENTS

| | | | |
|---|---|---|---|
| 4,039,280 | 8/1977 | Kienow et al. | 432/252 |
| 4,253,823 | 3/1981 | Holdner | 432/192 |
| 4,842,511 | 6/1989 | Young | 432/192 |
| 4,859,175 | 8/1989 | Doeyer et al. | 432/192 |
| 4,874,313 | 10/1989 | Schwenningen | 432/252 |
| 5,078,595 | 1/1992 | Roenigk et al. | 432/192 |
| 5,163,831 | 11/1992 | Hammond | 432/252 |

*Primary Examiner*—David A. Okonsky

*Attorney, Agent, or Firm*—John F. A. Earley; John F. A. Earley, III

[57] ABSTRACT

The invention relates to a partition wall, made up of a multiplicity of segments intended for a multi-compartment furnace as used for firing graphite electrodes, for instance. The invention calls for expansion joints to be incorporated between the segments in a row of segments.

8 Claims, 2 Drawing Sheets

Figure 1:
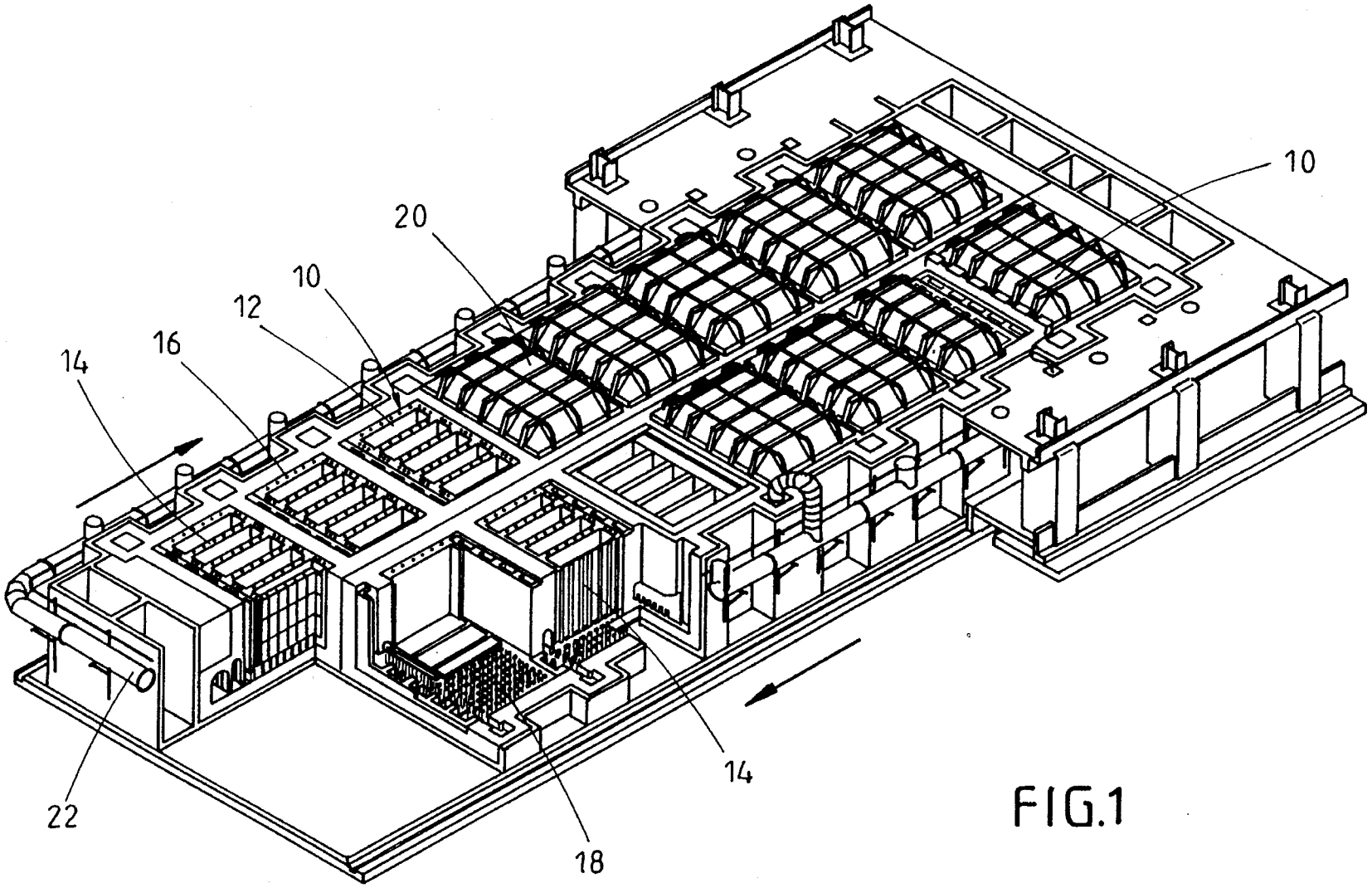

FIG. 2
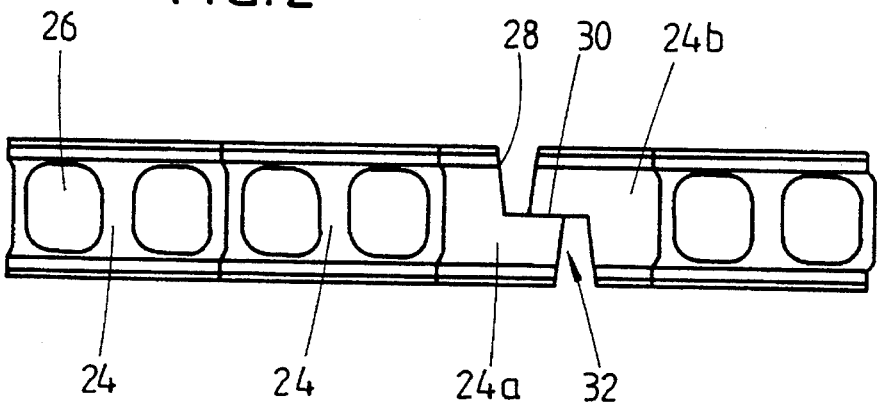
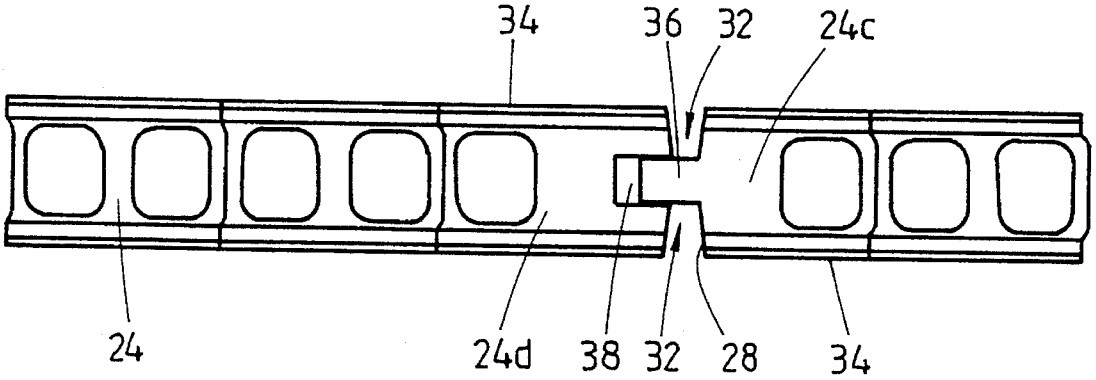
FIG. 3

SAGGER WALL FOR A RING PIT FURNACE

The present invention pertains to a sagger wall being called modular wall hereinafter, composed of a plurality of segments for a ring pit furnace, which is called modular furnace hereinafter.

For example, carbon or graphite electrodes are fired in soaking pit furnaces, which are usually designed as follows:

The furnace plant consists of a plurality of chambers, which are arranged in series and next to each other such that—viewed as an integral unit—they form an approximately annular shape. Each chamber is in turn subdivided into so-called modules or cassettes, which is achieved by arranging corresponding partitions.

The individual chambers are connected to one another such that the flue gases can be led from one chamber to the next. This is usually achieved by the so called sagger or modular walls having continuous flue gas channels, through which the flue gases flow from bottom to top and from top to bottom. To make possible this sinusoidal or meander-shaped gas flow, the individual chambers are closed with covers, and there is a hollow space between each chamber cover and the top ends of the modular walls, and this hollow space makes possible a gas flow, just as the hollow space formed under the modular bottoms.

One or two (of, e.g., 16 to 24 chambers) are designed as firing chambers during operation, while the chambers arranged in front of them—in the direction of flow of the flue gases— can be considered to be heating chambers, and the chambers located behind them can be considered to be cooling chambers.

The fired products are also removed and new, nonfired goods are introduced in the area of the chambers arranged behind the firing chambers when viewed in the direction of flow. The said electrodes are usually placed into a bed of filling powder, which makes possible, above all, a protection against oxidation.

Thermal expansions and contractions, which require suitable measures, inevitably occur due to the continual heating/cooling. It has been known that expansion joints can be arranged for this purpose, e.g., in the connection area between a transverse wall and a longitudinal wall. The corresponding expansion joints were then filled with ceramic fiber materials and covered. However, due to the thermal and mechanical load, the filling materials frequently have a very limited use time and are used up and must be replaced after, e.g., three firing cycles. Aside from this (undesired) maintenance cost, another aggravating circumstance is the fact the modular walls often have a height of 4 to 6 m, which makes it difficult to introduce the fiber materials in the area of the corner-side expansion joints.

It has now been found that two advantages can be achieved at the same time by placing the expansion joints away from the corner areas in the direction of the center of the modular walls and by a special design of the expansion joints: On the one hand, the expansion joints no longer need to be plastered, and, on the other hand, they are self-cleaning.

The present invention is based on the consideration that the expansion joints should be designed to be such that even though free mobility of adjacent components is guaranteed for absorbing the changes in length caused by thermal effects, the separation of adjacent modular spaces is ensured at the same time. In other words, the depth of the expansion joints shall be smaller than the thickness of the modular wall.

In its most general embodiment, the present invention discloses a modular wall composed of a plurality of segments for a modular furnace, wherein at least some of the segments have openings, which complement one another to form vertically extending, continuous flue gas channels, wherein at least two adjacent segments along each horizontal row of segments are designed and arranged such that they form expansion joints between them with their corresponding beveled front surfaces, and the said expansion joints expand from the inside to the outside, and a closed connection area is formed in the horizontal direction at right angles to the wall surface.

Because of the size of the modular walls (example: length 4 m, height 6 m, width 30 cm), they are usually composed of segments (bricks). This is usually done in the manner of building a wall.

At least two segments within one row of segments should be designed such that expansion joint areas are formed from both sides. The individual rows of segments can be adjusted to one another, so that the expansion joints extend on both sides of the modular wall over the entire height and aligned with one another. However, it is also possible to design the expansion joints at a different point from one row of segments to the next, or to design a plurality of rows of segments with aligned expansion joints, and subsequently to design, in turn, a plurality of rows of segments with an expansion joint that is offset in relation to it.

This also increases the stability of the modular wall, especially in the latter embodiments.

The segments used to form the expansion joints may be specifically designed in various manners.

According to an advantageous embodiment, the segments, which form the expansion joint between them, shall have an essentially L-shaped base and shall be arranged in a mirror-inverted manner in relation to one another, and the inner surfaces of the free L legs shall be in contact with one another at least at their free ends. Consequently, while the expansion joint is provided in the area of the front surfaces of the two segments, the connection area ensures that adjacent modular spaces are completely separated from one another.

The special geometric design of the expansion joints offers the advantage that it is quasi self-cleaning. The filling powder (e.g., powdered coke), which is filled into the modules, fills the area of the expansion joints, on the one hand, but it also makes possible the mobility of the corresponding segments in relation to one another at the same time, and the filling powder falls out of the expansion joints automatically when it is removed from the module.

Thus, any kind of maintenance is eliminated, compared with the prior-art expansion joints in the corner area. However, it is possible, above all, to completely dispense with the filling of the expansion joints with a consumable fiber material, as a result of which the maintenance cost and the operating costs are markedly reduced.

However, should it ever become necessary to clean the expansion joints, it can easily be done, especially in the case of the above-mentioned trapezoidal cross section.

It is advantageous compared with the coke oven according to CH-PS 258,544 that stresses on the bricks are avoided when the expansion joints close up during the expansion of the bricks caused by thermal effects, because, as is shown, the filling powder is previously squeezed out.

According to an alternative embodiment, the segments which form the expansion points between them may also be of the tongue-and-groove design on their corresponding surface sections. One segment, e.g., in the middle between the wall-side segment surfaces, has a tongue, and the adjacent segment, which corresponds to it, has a groove. The arrangement is done such that the front surface of the tongue is at a spaced location from the base of the groove, as a result of which the other front surfaces of the segments are also arranged at spaced locations from one another. Free mobility of the segments in relation to one another is readily ensured in this embodiment as well. The expansion joints can be designed with trapezoidal cross section by correspondingly provided beveled surfaces on the segments in this case as well.

It is obvious that the design of the modular walls otherwise corresponds to the prior-art design. Thus, the segments are composed such that continuous flue gas channels, which make possible the flow of gas from the modular bottom substructure to the area below the chamber cover and vice versa, are formed in the modular wall.

Another advantage of the modular wall described is the fact that even existing furnace plants can be retrofitted.

The present invention will be explained in greater detail below on the basis of an exemplary embodiment. In the drawing, FIG. 1 shows a perspective top view of a module-type annular soaking pit furnace according to the state of the art, FIG. 2 shows a top view of a modular wall with the design according to the present invention, and FIG. 3 shows a top view of another embodiment of a modular wall of a design according to the present invention, always in highly schematic representations.

FIG. 1 shows a module-type annular soaking pit furnace for firing graphite electrodes, as it is currently available from the Applicant. Since the furnace as such is known, only the most important components will be briefly described below.

The furnace consists of a total of 16 chambers 10, which are arranged in an annular pattern one behind the other in two rows, with the fire circulating clockwise.

Five modules 12, which are delimited by four circumferential modular walls and four partitions 14, are provided within each said chamber 10. Flue gas channels 16, which extend from the modular bottom substructure 18 to the area below each chamber cover 20, are provided in each said modular wall 14. A circumferential flue gas pipeline 22 is partially recognizable.

While expansion joints are provided according to the state of the art in the connection area of the said modular walls 14 and the said circumferential modular walls, the expansion joints are arranged only as shown, e.g., in FIGS. 2 and 3.

FIGS. 2 and 3 show a top view of the topmost row of bricks (segments) of a said modular wall 14. The rows of segments located under it are arranged either analogously or—with respect to the expansion joints—in an offset pattern, as shown above.

FIG. 2 first shows the arrangement of three conventional segments 24 with two openings 26 each, which form, together with the said openings 26 located under them, a said flue gas channel 16. The individual segments are fitted snugly against each other via flattened tongue-and-groove joints.

However, two segments, 24*a* and 24*b*, are designed differently to form expansion joints, namely, with an essentially L-shaped base in the exemplary embodiment according to FIG. 2.

The said two segments 24*a* and 24*b* are arranged offset in a mirror-inverted manner in relation to one another, such that their front surfaces 28 are beveled and arranged at spaced locations from one another, while the inner surfaces 30 are located against each other in the end area.

Expansion joints 32 with essentially trapezoidal cross section are thus formed between the said segments 24*a, b,* but the modular wall remains closed at the same time in the area of the said inner surfaces 30 that are in contact with one another, so that there is no open connection between adjacent modules 12. An embodiment with only one expansion joint on one side would also be possible, and an expansion joint would be provided in this case in an offset position on the other side between additional segments.

Mobility of the said segments 24, 24*a*, 24*b* in relation to one another is thus guaranteed even at elevated temperatures.

One segment 24*c* in the exemplary embodiment according to FIG. 3 is designed such that it has a tongue 36 approximately in the middle between the wall-side segment surfaces 34, while the adjacent segment 24*d* has, correspondingly hereto, a groove 38. The said segments 24*c*, 24*d* are again designed otherwise with said beveled front surfaces 28, which complement one another to form a trapezoidal expansion joint 32. A distance is at the same time maintained between the front surface of the said tongue 36 and the base of the said groove 38.

Analogously to the exemplary embodiment according to FIG. 2, the segments are able to readily absorb changes in length caused by thermal effects because of the provision of the said expansion joints 32 in this case as well. At the same time, adjacent modules 12 are securely separated from one another via the said tongue-and-groove arrangement 36, 38.

When filling the said modules 12 with a filling powder (powdered coke in this case), into which the graphite electrodes to be fired are inserted, the powdered coke fills the said expansion joints 32, but free mobility of the said adjacent segments 24*c, d* continues to be guaranteed because of the loose packing.

When the powdered coke is removed after firing, the said expansion joints 32 clean themselves quasi automatically due to the powdered coke falling out (due to the trapezoidal cross-sectional area of the said expansion joints 32). However, the said expansion joints 32 can also be cleaned by hand with ease, if necessary.

We claim:

1. Modular wall composed of a plurality of segments for a modular furnace, wherein at least some of the segments have openings which complement one another to form vertically extending, continuous flue gas channels when said segments are placed in position to form said modular wall, wherein at least two adjacent segments along each horizontal row of segments form an expansion joint, said adjacent segments comprising complementing front surface profiles having a surface parallel to the plane of the wall and a surface transverse to the plane of the wall, said front surfaces being constructed and arranged to overlap at their parallel surfaces to form a closed connection area in the direction at right angles to the plane of the wall, and constructed and arranged to form expansion spaces between opposed transverse surfaces, the width of said expansion spaces expanding in the direction proceeding outwardly from said parallel surfaces to the outer surface of said adjacent elements.

2. Modular wall in accordance with claim 1, wherein said expansion spaces of each row of segments are aligned with each other.

3. Modular wall in accordance with claim 1, wherein said expansion spaces of one row of segments are arranged offset in relation to expansion spaces of the adjacent vertical row of segments.

4. Modular wall in accordance with claim 1 in which the expansion spaces (32) have an approximately trapezoidal cross section.

5. Modular wall composed of a plurality of segments for a modular furnace, wherein at least some of the segments have openings which complement one another to form vertically extending, continuous flue gas channels when said segments are placed in position to form said modular wall, wherein at least two adjacent segments along each horizontal row of segments are profiled at their corresponding front surfaces to form a closed connection area in the horizontal direction between them, at right angles to the wall surface, and to form expansion spaces, expanding from said closed connection area to the outer surface of said segments wherein the segments which form said expansion spaces (32) between them, have an L-shaped base and are arranged in relation to one another such that the inner surfaces of the free L-legs are in contact with one another at least at their free ends, while the beveled front surfaces of each L-leg stand in spaced relationship to the front surfaces of the corresponding segment, forming said expansion space between them.

6. Modular wall in accordance with claim 1, in which the segments, which form expansion spaces between them, are designed on their corresponding surface sections in the manner of a tongue-and-groove design, wherein one segment has, approximately in the middle between the wall-side segment surfaces, a tongue, and the adjacent segment has, corresponding thereto, a groove, and the front surface of the tongue is located at a spaced location from the base of the groove.

7. Modular wall in accordance with claim 5, in which the expansion joints (32) have an approximately trapezoidal cross section, and in which the segments (24*a, b*), which form expansion joints (32) between them, have an essentially L-shaped base and are arranged in relation to one another such that the inner surfaces (30) of the free L-legs are in contact with one another at least at their free ends.

8. Modular wall in accordance with claim 3, in which the expansion joints (32) have an approximately trapezoidal cross section, and in which the segments (24*c, d*), which form expansion joints (32) between them, are designed on their corresponding surface sections in the manner of a tongue-and-groove design, wherein one segment (24*c*) has, approximately in the middle between the wall-side segment surfaces (34), a tongue (36), and the adjacent segment (24*d*) has, corresponding thereto, a groove (38), and the front surface of the tongue (36) is located at a spaced location from the base of the groove.

* * * * *